US006789318B2

(12) United States Patent
Frohne et al.

(10) Patent No.: US 6,789,318 B2
(45) Date of Patent: Sep. 14, 2004

(54) METHOD FOR PRODUCING LONGITUDINALLY WELDED HELICALLY CORRUGATED METAL TUBING

(75) Inventors: Christian Frohne, Hannover (DE); Michael Meyer, Brugwedel (DE); Friedrich Harten, Stadthagen (DE)

(73) Assignee: Nexans, Paris (FR)

( * ) Notice: Subject to any disclaimer, the term of this patent is extended or adjusted under 35 U.S.C. 154(b) by 41 days.

(21) Appl. No.: 10/247,558

(22) Filed: Sep. 20, 2002

(65) Prior Publication Data

US 2003/0056559 A1 Mar. 27, 2003

(30) Foreign Application Priority Data

Sep. 22, 2001 (DE) ..... 101 46 807

(51) Int. Cl.[7] ..... B21D 21/00

(52) U.S. Cl. ..... 29/890.053; 29/890.054; 72/51; 72/370.19

(58) Field of Search ..... 29/890.053, 890.054, 29/33 D, 33 T, 650; 72/51, 370.19

(56) References Cited

U.S. PATENT DOCUMENTS 782,017 A * 2/1905 Fairman ..... 72/51
2,366,087 A * 12/1944 Chernack ..... 156/432
2,499,853 A * 3/1950 Eckel et al. ..... 228/43
3,700,158 A * 10/1972 Schatz et al. ..... 228/17.5
3,843,758 A * 10/1974 Maroschak ..... 264/40.7
3,910,713 A * 10/1975 Maroschak ..... 408/1 R
3,941,296 A * 3/1976 Ziemek ..... 228/148
3,945,552 A * 3/1976 Tobita et al. ..... 228/17.5
3,973,424 A * 8/1976 Albes et al. ..... 72/177
4,072,453 A * 2/1978 Oltmanns et al. ..... 425/62
4,083,484 A * 4/1978 Polizzano et al. ..... 228/130
5,179,770 A * 1/1993 Block et al. ..... 29/17.3
5,515,603 A * 5/1996 Ziemek et al. ..... 29/828
6,073,473 A * 6/2000 Ziemek ..... 72/78
6,405,919 B2 * 6/2002 Frohne et al. ..... 228/173.7
6,550,300 B2 * 4/2003 Hoffmann et al. ..... 72/78

FOREIGN PATENT DOCUMENTS

JP 2001232422 A * 8/2001 ..... B21D/15/04

* cited by examiner

*Primary Examiner*—Essama Omgba
(74) *Attorney, Agent, or Firm*—Sughrue Mion, PLLC

(57) ABSTRACT

A method for producing longitudinally welded helically corrugated metal tubing, wherein a metal strip pulled from a strip supply is formed into tubing with a longitudinal slit, the longitudinal slit is sealed by welding and the corrugation is produced by a corrugation tool that is supported eccentrically and at an angle to the tubing axis, is freely rotatable in a rotationally driven corrugator head, and rolls off the surface of the tubing. The metal strip as well as the uncorrugated metal tubing are advanced by a feed device that is provided between the welding point and the corrugation unit. A second feed device (8) engages the corrugated tubing (7) directly behind the corrugation unit (6), and the feed rate of the second feed device is slower than the forward feed rate of the corrugated tubing (7) which results from the pitch of the corrugator disk and the rotational speed of the corrugator head.

2 Claims, 1 Drawing Sheet

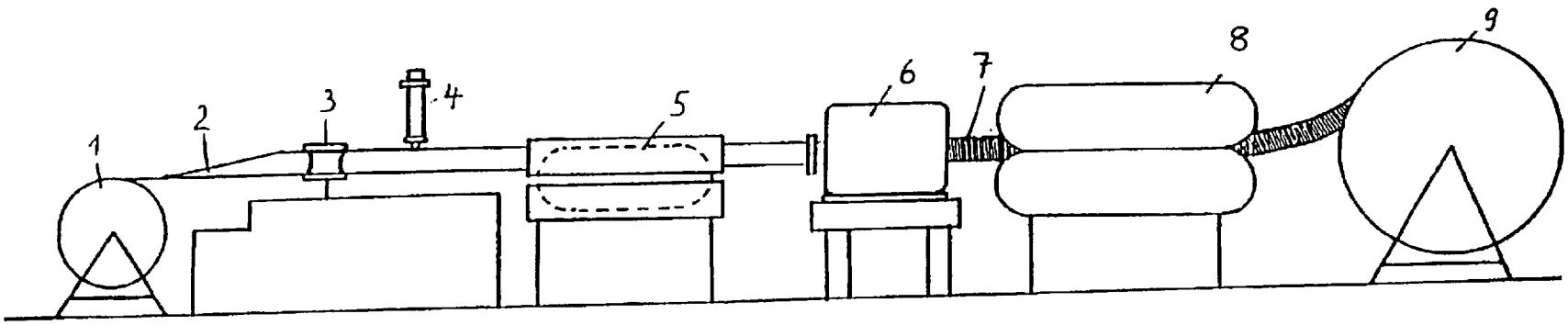
1
2
3
4
5
6
7
8
9

METHOD FOR PRODUCING LONGITUDINALLY WELDED HELICALLY CORRUGATED METAL TUBING

This application is based on and claims the benefit of German Patent Application No. 10146807.5 filed Sep. 22, 2001, which is incorporated by reference herein.

BACKGROUND OF THE INVENTION

The invention relates to a method for producing longitudinally welded helically corrugated metal tubing.

Examined German Application DE-AS 1 086 314 discloses a method representative of the field of the invention. With this prior art method, only tubing with a relatively flat corrugation can be produced. The reason for this is that the width of the corrugation valley cannot be smaller than the thickness of the disk-shaped corrugation tool. If the pitch is large, i.e., if the distance between the corrugation valleys is large, the corrugation depth is approximately equal to the depth by which the corrugation tool dips into the smooth tubing. If the pitch is made very small, the corrugation peak is pulled into the tubing as the corrugation tool dips into the smooth tubing. As a result, there is a dimensional relationship between the maximum corrugation depth and the pitch. Even selecting an extremely thin corrugation tool does not necessarily result in a tight pitch, since there is a lower limit of the width of the corrugation valley due to the toughness of the tubing material. For this reason, the prior art method is limited with respect to the flexibility of the resulting tubing.

To increase the flexibility of corrugated metal tubing, it has been attempted to stress the previously corrugated metal tubing after production, e.g., as described in published German application DE-PS 493 930.

From German publication DE 24 00 842 C it is known to corrugate the tubing under pressure in the direction of the longitudinal axis regardless of the forces applied for corrugation. For this purpose, the tubing is slowed after corrugation. The apparatus used for this purpose is provided with an annular tool of a variable diameter directly behind the corrugation unit to apply frictional forces and thereby compressive stresses in the direction of the longitudinal axis. The drawback of this method is that it is impossible to apply uniformly high frictional forces during the entire production process. As a consequence, the corrugation as seen over the length of the tubing is uneven.

SUMMARY OF THE INVENTION

An object of the present invention is to provide a method that makes it possible to produce tubing with a deeper corrugation or a smaller pitch, while the corrugation is uniform over the length of the tubing.

This object is attained partially by a feed device that engages the corrugated tubing directly behind the corrugation unit, where the feed rate of the feed device is slower than the advancing rate of the corrugated tubing.

The method according to the invention is particularly advantageous for the sheathing of plastic optical fibers that are used for signal transmission in motor vehicles.

BRIEF DESCRIPTION OF THE DRAWINGS

The invention will now be described in greater detail with reference to an exemplary embodiment, which is schematically depicted in the FIGURE.

DETAILED DESCRIPTION OF THE INVENTION

Metal strip 2, which is to be shaped, is pulled off reel 1. Between two revolving blade pairs (not shown) the strip is cut to size and formed into slit tubing in shaping stage 3. With the aid of welding unit 4, preferably an arc welding device or a laser welding device, the strip edges of the slit tubing are sealed and the tubing, which is now closed but still smooth, is grasped by a feed device 5 and is delivered to corrugation tool 6. The feed device is preferably a collet feed, as it is known from German Patent 11 64 355. The corrugated tubing 7 exiting from corrugation tool 6 is grasped by a belt feed 8 directly behind corrugation unit 6, and is delivered to a take-up reel 9.

Corrugation unit 6—as disclosed by the earlier-mentioned publication DE 1 086 314—comprises a corrugation tool that is set at an angle of less than 90° and is supported eccentrically to the longitudinal tubing axis and freely rotatable, in a rotationally driven corrugator head. The corrugation tool is an annular disk, the inner surface of which rolls off the smooth tubing and which, due to the eccentric support, cuts into the tubing wall and thereby produces a continuous helical corrugation. The speed at which the corrugated tubing 7 exits from the corrugation unit depends on the pitch of the corrugation tool relative to the longitudinal tubing axis, the ratio of the inside diameter of the corrugation tool to the outside diameter of the corrugated tubing as measured in the area of the corrugation valley, and the rotational speed of the corrugator head.

As an alternative, a corrugation unit as described in German Application 101 26 399.6 filed on May 31, 2001 may be used.

The corrugated tubing 7 is firmly held by belt feed 8. For this purpose, belt feed 8 comprises two endless loops that are driven by rollers and are made of an elastic material, e.g., rubber. Such belt feeds are known in the art.

According to the invention, the feed rate of belt feed 8 is lower than the speed of corrugated tubing 7 exiting from corrugation unit 6. The distance between corrugation unit 6 and belt feed 8 should be as short as possible to prevent buckling of corrugated tubing 7.

If the distance cannot be reduced to the necessary extent for structural reasons, a tube (not shown) may be arranged between corrugation unit 6 and belt feed 8 through which corrugated tubing 7 is guided. The inside diameter of this guide tube must be greater than the outside diameter of corrugated tubing 7. Its inside diameter depends on the degree of compression and the outside diameter of corrugated tubing 7 which changes as a function thereof.

The speed at which corrugated tubing 7 exits from corrugation unit 6 depends only on the rotational speed of the corrugator head for a specific tubing type with a defined corrugation depth and corrugation pitch.

By a suitable selection of the feed rate of belt feed 8, the corrugation depth can thus be increased within wide limits and the corrugation pitch can at the same time be reduced.

This effect is more readily observed in metals with a low modulus of elasticity than in those with a high modulus of elasticity. Aluminum and copper are well suited for the method according to the invention, while steel and high-grade steel are less suitable due to their high resilience.

In addition, with the present invention, a long strand-like material can be inserted into the slit tubing while it is still open the outside diameter of the material should be no more than the inside diameter of the corrugated tubing behind the second feed device. This strand-like material may be an optical fiber made of plastic.

What is claimed is:

1. A method for producing a longitudinally welded helically corrugated metal tubing in which a metal strip pulled from a strip supply is formed into a tubing with a longitudinal slit, the longitudinal slit is sealed by welding and a corrugation is produced on the tubing by a corrugation tool that is supported eccentrically and at an angle to a tubing axis, and freely rotatable in a rotationally driven corrugator head, and that rolls off a surface of the tubing, comprising:

advancing the metal strip and the uncorrugated metal tubing by a feed device that is provided between a welding point and a corrugation unit, wherein the corrugation unit includes the corrugation tool and the corrugator head; and engaging the corrugated tubing with a second feed device that is disposed directly behind the corrugation unit, wherein a feed rate of the second feed device is lower than an advancing rate of the corrugated tubing which results from a pitch of the corrugation tool and a rotational speed of the corrugator head, wherein the second feed device comprises two endless driven belts that are made of an elastically deformable material.

2. A method as claimed in claim 1, wherein the feed device engaging the uncorrugated tubing in front of the corrugation unit is a collet feed.

* * * * *